US006585353B1

(12) United States Patent
Kanematsu et al.

(10) Patent No.: US 6,585,353 B1
(45) Date of Patent: Jul. 1, 2003

(54) PRINTING INFORMATION PROCESSING SYSTEM, PRINTING SYSTEM, PRINTING INFORMATION PROCESSING METHOD AND PRINTING METHOD

(75) Inventors: Daigoro Kanematsu, Kawasaki (JP); Kentaro Yano, Yokohama (JP); Masao Kato, Kawasaki (JP); Minako Kato, Yokohama (JP); Mitsuhiro Ono, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/551,770

(22) Filed: Apr. 18, 2000

(65) Prior Publication Data

(65)

(30) Foreign Application Priority Data

Apr. 19, 1999 (JP) ..... 11-111501

(51) Int. Cl.[7] ..... B41J 2/21; B41J 2/205

(52) U.S. Cl. ..... 347/43; 347/15

(58) Field of Search ..... 347/40, 16, 15, 347/43; 358/515

(56) References Cited

U.S. PATENT DOCUMENTS

| | | | | |
|---|---|---|---|---|
| 5,225,849 A | | 7/1993 | Suzuki et al. | 347/14 |
| 5,760,798 A | | 6/1998 | Suzuki et al. | 347/14 |
| 5,929,876 A | * | 7/1999 | Bartolome | 347/20 |
| 5,992,971 A | | 11/1999 | Takahashi et al. | 347/43 |
| 6,375,307 B1 | * | 4/2002 | Vinals et al. | 347/41 |

FOREIGN PATENT DOCUMENTS

JP 5-220977 8/1993

* cited by examiner

*Primary Examiner*—Thinh Nguyen
(74) *Attorney, Agent, or Firm*—Fitzpatrick, Cella, Harper & Scinto

(57) ABSTRACT

A printing information processing system provided in the present invention calculates the total of printing signal values for printing onto at least one boundary area of the upper and lower adjacent boundary areas included in the upper and lower adjacent scanning print areas formed by print heads, and responding to the magnitude of this total of printing signal values performs correction on the magnitude of the print signal value for printing onto the boundary by the use of the print signal for at least one area of the upper and lower adjacent boundary areas.

25 Claims, 9 Drawing Sheets

PRINTING INFORMATION PROCESSING SYSTEM, PRINTING SYSTEM, PRINTING INFORMATION PROCESSING METHOD AND PRINTING METHOD

This application is based on Patent Application No. 11-111501 (1999) filed Apr. 19, 1999 in Japan, the content of which is incorporated hereinto by reference.

BACKGROUND OF THE INVENTION

1. Field of the Invention

The present invention relates to a printing system that has print heads equipped with a plurality of nozzles arrayed crossing the scanning direction of a carriage in the carriage and forms successive scanning print areas by repeating feed of a printing medium to the direction orthogonal to the scanning direction and scanning by the carriage, and a printing information processing system that provides printing signals to the printing system, and in particular to a technology to perform printing with correction of the ink density in the predetermined boundary areas in the vertically adjacent scanning print areas.

2. Description of the Related Art

As image printing systems that print images on printing media such as paper and OHP (Over Head Projector) sheets, a number of systems have been proposed that are equipped with print heads using a variety of printing methods. Those print heads use printing methods including, for example, wire-dot method, heat-sensitive method, heat-transfer method and ink-jet method. In particular, among them the ink-jet method, where printing is carried out by ejecting ink directly on printing media, has drawn attention as an excellent printing method for lower running costs and a quiet printing operation.

The above printing systems are equipped with scanning carriages that have print heads and move horizontally. In each of these types of printers equipped with a scanning carriage, a number of nozzles mounted on the print head are driven by printing information during scans by the carriage, and after printing has been completed over one scanning print area, the printing medium is forwarded vertically to the direction the carriage proceeds as much as one scanning print area. This scanning motion of the carriage and the forwarding of the print medium create predetermined images.

If the fed printing medium or paper has stopped at a location slightly departed from the right location because of, for example, friction and problems in the feeding mechanism, the bottom of the printed area overlaps the top of the following printed area. As a result, there will be deterioration in image printing quality because the ink condensed in the overlapped trail appears as what is called a black stripe. To cope with this problem, a number of measures to improve the precision of the paper feed mechanism have been proposed.

However, if the printing medium is, for example, normal paper where ink spreads easily, there still appears a black stripe in the boundary area between the bottom of the preceding printed area and the top of the subsequent printed area, even though the paper has been precisely located in the right position. Although the detail of its mechanism is not clear, it is probable that when ink is ejected on paper the osmosis of the printed area therein is enhanced and then the ejected ink on the subsequent area spreads into this adjacent printed area.

As a solution to this problem, a head shading method is disclosed in Japanese Patent Application Laid-open No. 5-220977 (1993) where the ink density fluctuation and black stripes will be eliminated by adjusting the density of each raster of the original image.

The above conventional technology, however, has the following problems.

The technology revealed in Japanese Patent Application Laid-open No. 5-220977 (1993) provides a density correction for the upper or lower nozzles on the print head. By this technology, however, it is impossible to detect ink smears caused by the overlap of two or more colorants, when printing is performed by two or more print heads as is the case with color ink-jet printing systems. This technology, therefore, cannot eliminate black stripes that appear in full-color images.

In order to prevent ink smears, what is called a two-path printing method has been carried out where the image of one scanning print area is created by two scans of the carriage, with the printed paper being forwarded in the direction the paper is fed as long as half the full forwarding range. This method, in turn, has another problem that the printing speed becomes significantly low, while smears can be eliminated.

SUMMARY OF THE INVENTION

The purpose of this invention is to provide a printing method and printing system that can eliminate the black stripe in the boundary area and provide an excellent printing speed when full-color images are created by a plurality of print heads.

In a first aspect of the present invention, there is provided a printing information processing apparatus providing printing signals to a printing apparatus which has a plurality of print heads in a carriage, each of the heads being comprised of an array of printing elements, the carriage and a predetermined printing medium being relatively moved to the primary scanning direction and a sub-scanning direction orthogonal to the primary scanning direction respectively, and by the use of the printing elements forms scanning print areas adjacent to each other sequentially along the sub-scanning direction based on printing signals during the carriage movement over the printing medium to the primary scanning direction, the printing information processing apparatus comprising:

means for calculating a total value of printing signals sent to each of the print heads for printing onto at least one of upper or lower adjacent boundary areas in upper and lower adjacent scanning print areas formed by the print heads; and means for correcting the printing signals for at least one of the upper and lower adjacent boundary areas, based on the total value of printing signals.

In a second aspect of the present invention, there is provided a printing apparatus comprising a plurality of print heads comprised of an array of printing elements, a carriage holding the print heads and shuttling along a primary scanning direction, means for moving a printing medium to a sub-scanning direction orthogonal to the primary scanning direction, and means for controlling the print heads equipped with the printing elements based on printing signals, wherein the carriage moves in the primary scanning direction, the printing medium moves in the sub-scanning direction, and a plurality of scanning print areas are formed sequentially along the sub-scanning direction based on printing signals during the carriage movement, and the means for controlling the print heads comprising:

means for calculating the total value of printing signals sent to each of the print heads, the printing signals for printing onto at least one of upper or lower adjacent boundary areas in upper and lower adjacent scanning print areas formed by the print heads, means for correcting printing signals for at least one of the upper and lower adjacent boundary areas, based on the total value of printing signals calculated by the calculation, and a printing element control unit that controls each of the printing devices of the print heads based on the printing signals corrected by the means for correcting printing signals.

In a third aspect of the present invention, there is provided a printing information processing method in which printing signals are provided to a printing apparatus which has a plurality of print heads in a carriage, each of the heads being comprised of an array of printing elements, the carriage and a printing medium being relatively moved along the primary scanning direction and the sub-scanning direction orthogonal to the primary scanning direction, respectively, and by means of the printing elements forms scanning print areas adjacent to each other sequentially along the sub-scanning direction based on the printing signals during the carriage movement over the printing medium along the primary scanning direction, each of the scanning print areas having the same length as that of the array of the printing elements measured in the sub-scanning direction;

the printing information processing method comprising the steps of:

calculating a total value of printing signals sent to each of the print heads for printing with respect to at least one of upper or lower adjacent boundary areas in upper and lower adjacent scanning print areas formed by the print heads; and correcting the printing signals of at least one of the upper and lower adjacent boundary areas, based on the total value of printing signals.

In a fourth aspect of the present invention, there is provided a printing method in which printing signals are provided to a printing apparatus which has a plurality of print heads in a carriage, each of the heads being comprised of an array of printing elements, the carriage and a predetermined printing medium being relatively moved along a primary scanning direction and a sub-scanning direction orthogonal to the primary scanning direction respectively, and by means of the printing elements forms scanning print areas adjacent to each other sequentially along the sub-scanning direction based on printing signals during the carriage movement over the printing medium to the primary scanning direction;

the printing method comprising the steps of:

controlling each of the printing elements of the print heads based on the printing signals corrected by the correction step, calculating the total value of printing signals sent to each of the print heads for printing with respect to at least one of upper or lower adjacent boundary areas in upper and lower adjacent scanning print areas formed by the print heads; and correcting the printing signals of at least one of the upper and lower adjacent boundary areas, corresponding to a magnitude of the total value of printing signals.

In the present invention, because the total value of printing signals for the boundary area is calculated to control the printing signals thereof, the printing in the boundary area is always performed with an appropriate amount of ink, and emergence of black stripes can be prevented. That is, in the case of color printing conducted with a high ink density, if a significant amount of ink is ejected from the print heads of different colors, the ejected ink will spread in a wide range with high density to the boundary area where two scanning areas are adjacent to each other, and as a result, it is very probable that a black stripe appears in the boundary area. In the present invention, however, since the value of printing signals sent to each print head is calculated and this value is corrected to reduce the printing signals for the boundary area if it exceeds a predetermined threshold value, excessive supply of ink to the boundary area is prevented. Then the spread of ink is minimized and thereby emergence of a black stripe is prevented in advance. Further, the present invention allows high-speed printing because printed areas are sequentially formed by the full forwarding of each printed area scanned by the print heads.

The above and other objects, effects, features and advantages of the present invention will become more apparent from the following description of the embodiments thereof taken in conjunction with the accompanying drawings.

BRIEF DESCRIPTION OF THE DRAWINGS

FIG. 5 is a flowchart showing the relationship of FIGS. 5A and 5B,

DETAILED DESCRIPTION OF PREFERRED EMBODIMENTS

By referring to the accompanying drawings, embodiments of the present invention will be explained.

<Printing System Overview>

First, the schematic structure of the printing system employed in embodiments of this invention is explained.

Figure 1:
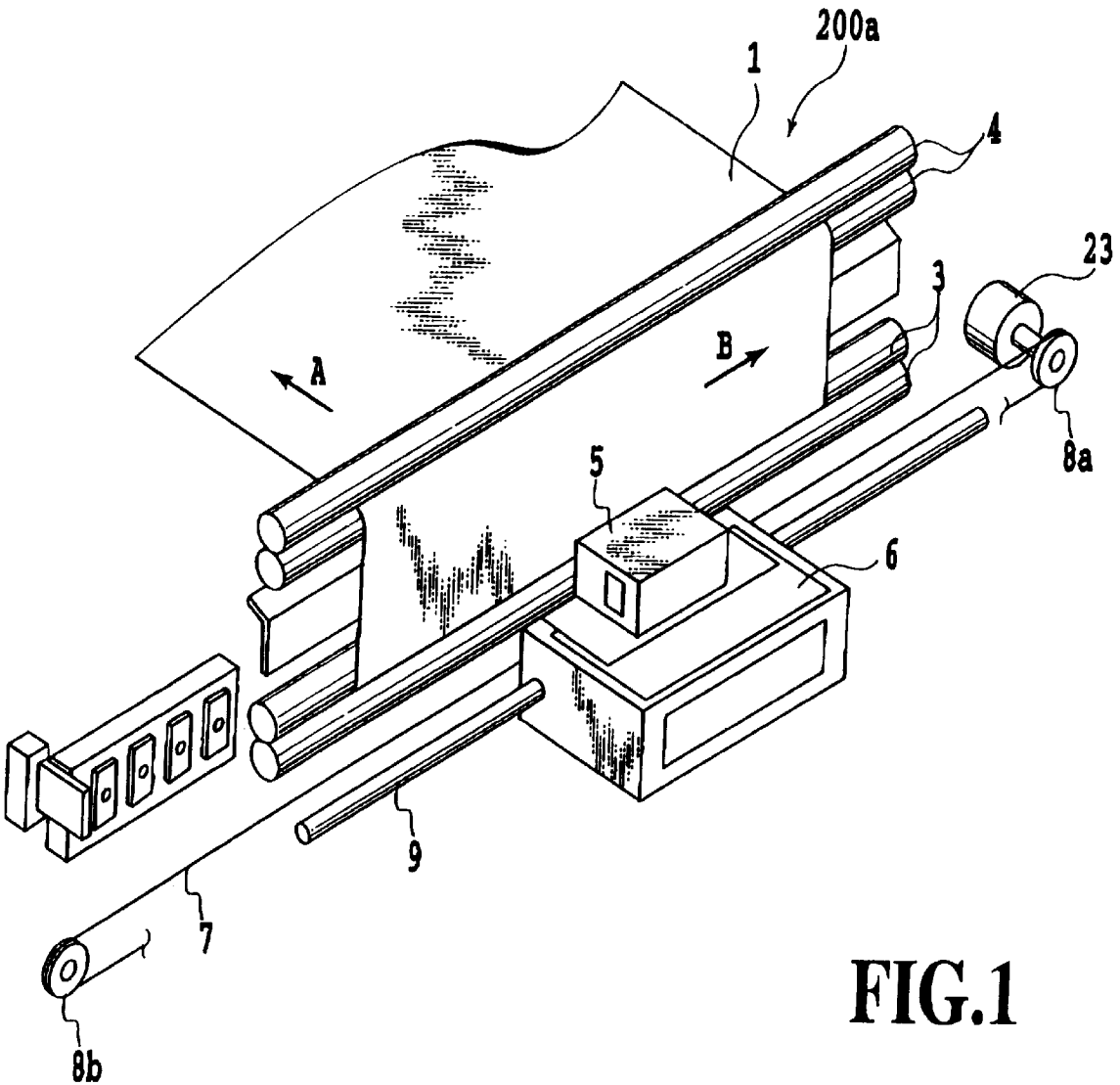
FIG. 1 is a perspective view showing an essential part of the printing system in an embodiment of this invention.

The printing system employed in the embodiments of the invention is a color printing system operated by the ink-jet method. Its essential part has the printing means 200*a* of which structure is shown in FIG. 1. In FIG. 1, reference number 1 represents a printing sheet such as paper or plastic sheet, and a plurality of such sheets are stacked in a cassette. The sheets are separated to be supplied one at a time by rolling feed rollers (not shown) that contact the top or bottom sheet in the stack, and placed in a platen with a predetermined interval apart. Then the printing sheet 1 is forwarded in the direction (sub-scanning direction) of arrow A by a first feed roller pair 3 and a second feed roller pair 4 driven by associated stepping motors (not shown).

Denoted 6 is a carriage that shuttles straight along a horizontal guide shaft 9 held in the direction orthogonal to the above sub-scanning direction A. The carriage 6 is linked to a carriage motor 23 through a belt 7 and pulleys 8*a* and 8*b*, and driven by the carriage motor to move reciprocally along the guide shaft 9. The carriage 6 is equipped with the print head 5 that performs printing on the printing sheet 1 and with an ink cartridge (not shown) that supplies ink to this print head. In this printing system, as print heads, four types of heads that eject cyan (C), magenta (M), yellow (Y) and black (K) ink are equipped and each head has 256 nozzles.

In the above construction of the printing means 200*a*, the print head 5 while scanning in the primary scanning direction (denoted by arrow B) ejects ink onto the printing sheet 1 in response to the ink ejection signals to perform printing in the sub-scanning direction on the scanning print area of which width corresponds to the array of the 256 nozzles. The print head 5 returns to the home position, as required, and removes clogging in the nozzles by the use of an ejection performance recovery device. Then the feed roller pairs 3, 4 are driven to forward the printing sheet 1 as much as the width of one scanning print area in the direction of arrow A. By repeating this series of operations, an ink image consisting of a predetermined number of rasters is formed on the printing sheet 1.

Figure 2:
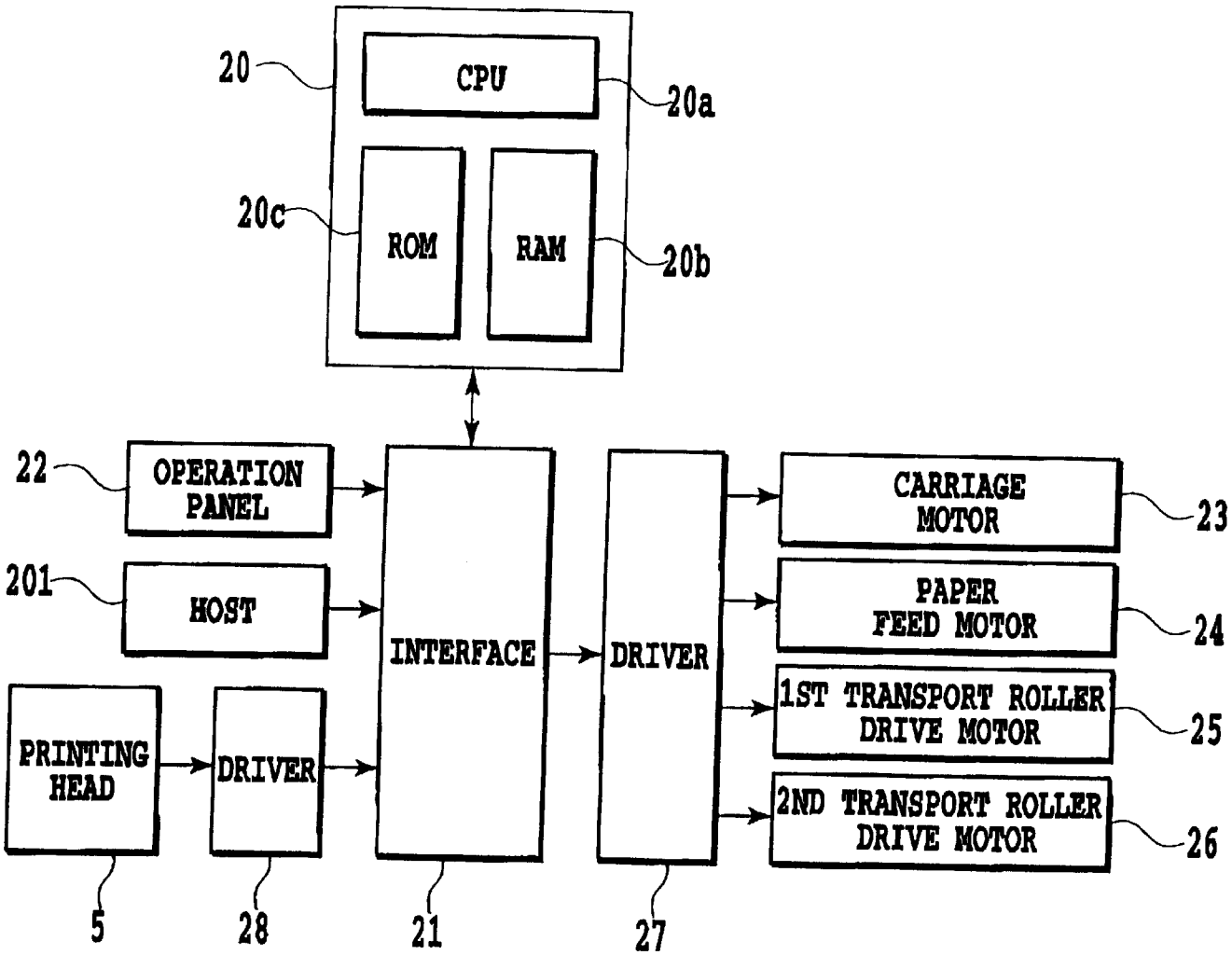
FIG. 2 is a block diagram showing a configuration of the control unit of the printing system shown in FIG. 1.

Next, explanation will be made of a control system for controlling the drive of each member of the printing apparatus. As shown in FIG. 2, this control system is equipped with an operation controller 20 which possesses control programs executed by a CPU 20*a* such as a micro-processor, a ROM 20*c* which stores various data, and a RAM 20*b* which is used as the work area of the CPU 20*a* and also temporarily stores various data such as printing image data. To this operation controller 20 are connected a driver 27 for driving an interface 21, an operation panel 22, motors (a carriage motor 23, a paper feeder motor 24, a first carrier roller driving motor 25, and a second carrier roller driving motor 26), and a driver 28 for driving the printing head.

The operation controller 20 will conduct input and output of various information (for instance, pitches of characters or types of characters) from a host 201, described later, via the interface 21, and input and output of the image signals (input and output of information), which are sent from and received to an external apparatus. In addition, the controller 20 will output ON and OFF signals for driving each of the motors 23 to 26 via the interface 21 and the image signals, and driving of each part is conducted in response to signals.

<Outline of Image Processing Apparatus>

Next, explanation will be made of a printing information processing apparatus that forms data to be executed by the printing operation in the printing apparatus 200.

Figure 3:
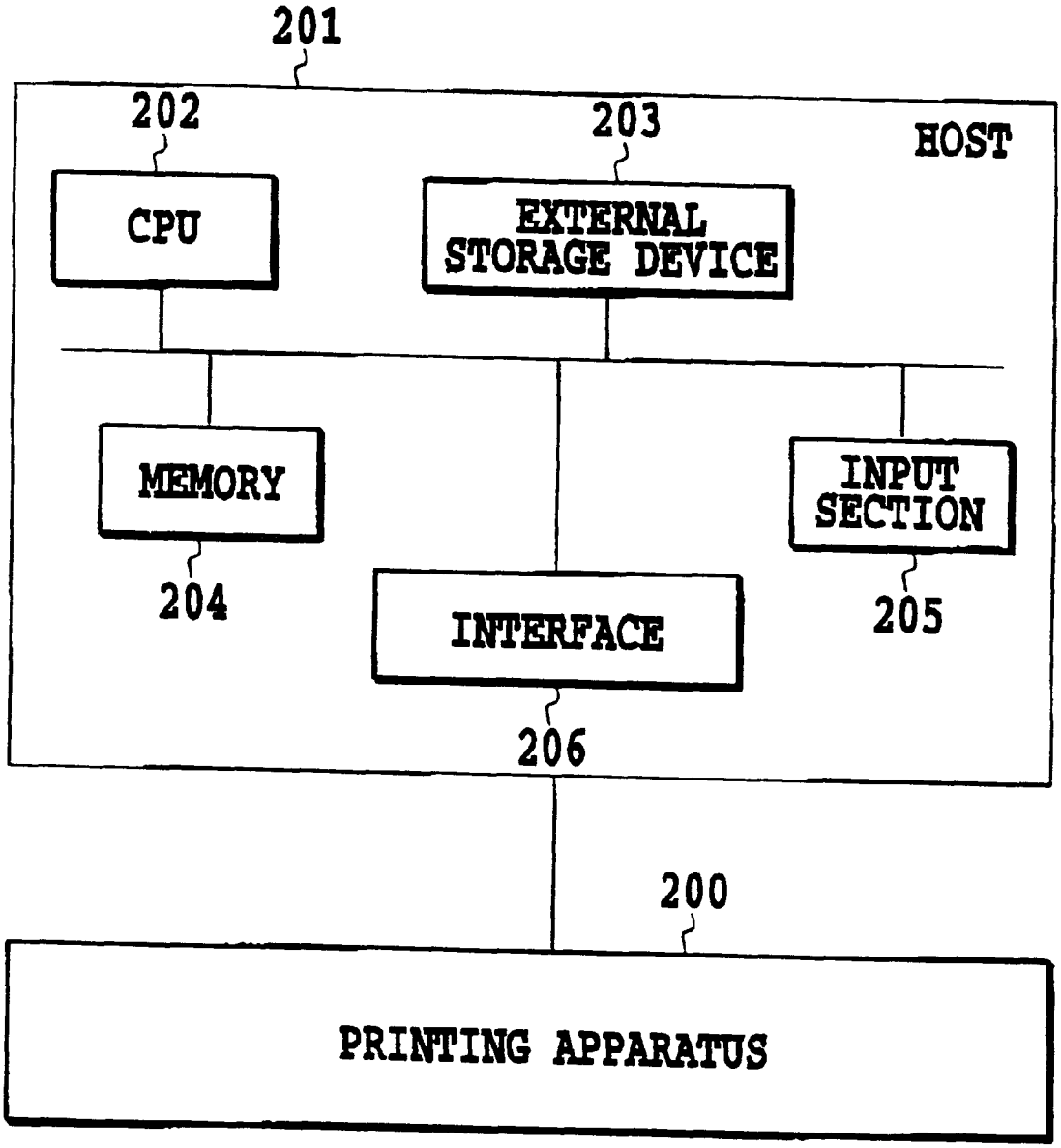
FIG. 3 is a block diagram showing a configuration of the printing information processing system in an embodiment of this invention.

FIG. 3 illustrates a host computer (hereinafter simply referred to as "a host") used as an information processing apparatus in each of the embodiments. In the drawing, the host 201 is equipped with a CPU 202, a memory 204 (printing information generating means), an external memory 203, an input section 205, and an interface 206 that connects to the printing apparatus 200. The CPU 202 realizes the procedures of color processing and quantization, described later, in order to execute the program that is stored in the memory 204. This program and printing information are stored in the external memory 203, and after reading from this, it is fed to the CPU 202, and temporarily stored in the memory 204. The host 201 is connected to the printing apparatus 200 via the interface 206, and it will send the image data that has undergone the color processing to the printing apparatus 200, and the printing operation will be executed.

Figure 4:
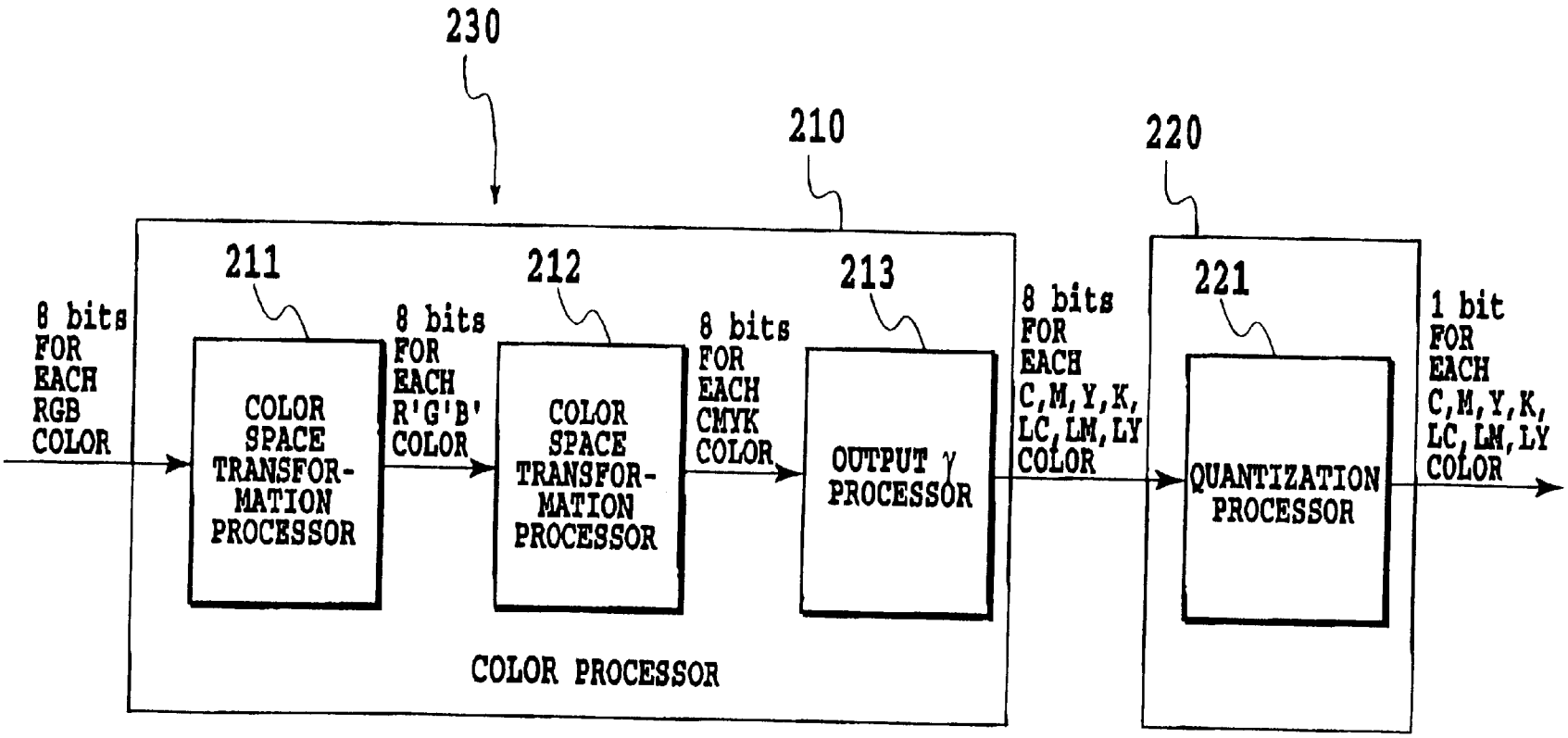
FIG. 4 is a block diagram showing an operation sequence of the image processing performed in the printing information processing unit.

Furthermore, FIG. 4 is a functional block diagram illustrating the function of an image processor 230 that is realized by the host 201. This image processor 230 outputs the image data of R, G and B, each color consisting of 8 bits (256 gradation) which has been input as 1-bit data of each of the colors C, M, Y, K, LC, LM and LY, and it comprises a color processor 210 and a quantizer 220. The color processor 210 comprises a color space transformation processor 211, and a color transformation processor 212, and an output γ processor 213. Among them, the color space transformation processor 211 and the color transformation processor 212 are composed of a three-dimensional LUT (a Look Up Table) and the output γ processor 213 is composed of a one-dimensional LUT (a Look Up Table). Furthermore, each of the LUTs is stored in the memory 204 in the host computer 201.

In the image processor 230 having the above-described arrangement, bit data of each of the colors R, G and B read from the external memory is first of all converted to 8-bit data of each of colors R', G' and B' by the three-dimensional LUT. This processing is referred to as color space transformation processing (Pre-Stage Color Processing), and it is conversion processing for correcting the difference between the color space of an input image and the reproduced color space of the output apparatus. The 8-bit data of each of the colors R', G' and B' that have undergone color space transformation processing are converted into the following 8-bit data of each of the colors C, M, Y, K, LC, LM and LY by the three-dimensional LUT. This color transformation processing is referred to as post-stage color processing, and it is conversion processing for correcting the difference between the color space of the input image and the reproduced color space of the output apparatus.

Furthermore, the 8-bit data of each color R', G', B' that have undergone pre-stage color processing are converted to 8-bit data of each of the colors C, M, Y, K, LC, LM and LY by the three-dimensional LUT which composes the following color transformation processor 212. This color transformation processing is referred to as the post-stage color processing, and it involves conversion processing of the RGB system colors of the input system into the C, M, Y and K (LC, LM and LY) system colors of the output system. Furthermore, the image data to be input are in most cases three primary colors (R, G and B) of the additive color mixtures for illuminants such as displays, but in the case of a printer in which the colors are represented by the reflection of light, coloring materials of the three primary colors (C, M, Y) of the subtractive color mixtures are used, and therefore, the color transformation is necessary.

The three-dimensional LUT used for pre-stage color processing and the three-dimensional LUT used for the post-stage color processing discretely maintain the data, and although the data between the maintained data are obtained by interpolation. Since this interpolation method is a publicly known technology, detailed explanation of the interpolation is omitted.

The 8-bit data of each of the colors C, M, Y, K, LC, LM and LY, that have undergone the post-stage color processing, undergoes output γ correction by the one-dimensional LUT that composes the output γ processor 213. In most cases, the relationship between the number of printing dots per unit area and output characteristics (reflection density, etc.) will not become linear. Thus, γ correction can secure the linear relationship between the input level of the 8-bit C, M, Y, K, LC, LM and LY and the output characteristics at that time. The respective differences of the output characteristics for the printing head that prints each of the color materials detected by the color deviation detector, described later, can be realized by changing the input-output relationship of the one-dimensional LUT. For instance, in the case where the output characteristic values of the printing head to print the C coloring material are larger than expected output values, as described later, the input-output relationship of the one-dimensional LUT is changed so as to compensate to achieve reproduction at gradation as expected, thus achieving the correction of individual differences of each equipment.

The above explanation is the outline of the image processor 230, and the 8-bit data of each of the color inputs R, G and B are converted into the 8-bit data of each of the color inks C, M, Y, K, LC, LM and LY possessed by the printing apparatus. The color printing apparatus in the present embodiment is a binary printing apparatus, so the 8-bit data of each of the colors C, M, Y, K, LC, LM and LY undergo quantization processing of one-bit data of each of the colors C, M, Y, K, LC, LM and LY in a quantization processor 221 at a next stage. In this embodiment, a quantization method based on an error diffusion method that enables the smooth expression of photographic half-tone images is realized by a binary printing apparatus. By the error diffusion method, the 8-bit data of each of the colors C, M, Y, K, LC, LM and LY undergo quantization, to form printing data of one-bit data for each of the colors C, M, Y, K, LC, LM and LY.

The details of the quantization method using this error diffusion method has been published in "Nikkei Electronics", May, 1987 (pages 50 through 65), as well as various other literatures. Since it is a publicly known technology, detailed explanation will be omitted here.

Further, it is assumed here that 100 percent of each yellow (Y), magenta (M), cyan (C) and black (K) ink can be ejected. Each pixel, thus, receives up to 400 percent of ink from the color print heads. Denoted e1 and e2 are the adjacent boundary areas each in the upper scanning print area E1 or lower scanning print area E2 (see FIGS. 7A and 7B). The area where the correction is conducted on print signals is the area e2, and more specifically the top four rasters in the lower scanning print area. It is also assumed that the signal for each color stands at an 8-bit value ranging between 0 and 255.

In the above construction of the printing system 200, the printing signals that have undergone the aforementioned signal conversions and a later-mentioned boundary correction are transferred from a host computer to the printing system 200 through an interface and stored in the RAM 20*b* thereof for a while. The printing system 200 carries out printing as follows based on the stored printing signals.

When the printing system 200 has received a printing command, the CPU 20*a* of the printing system 200 activates the carriage motor 23 to move the carriage 6, reads out the aforementioned binarized printing signals, activates the head driver 28 to start printing, and then operates to form the scanning print area E1, namely, the 256 rasters.

As a following step, the CPU 20*a* activates the paper feed motor to forward the paper as much as the width of 256 rasters, and again moves the carriage 6 to perform a second primary scanning and printing on the scanning print area E2. At the primary scans after the first scan, the above-mentioned correction is conducted on the printing signals for the top four rasters (the lower boundary area e2). Then the printing of 256 rasters is conducted based on the binary data of those print signals.

As explained above, this printing system allows high speed printing because it has adopted what is called a one-path method where the paper feeding pitch is the full width of one scanning print area.

<Boundary Correction Process>

Next, the boundary correction process performed in an image processing part 201 is explained.

[Process Routine]

Figure 5A:
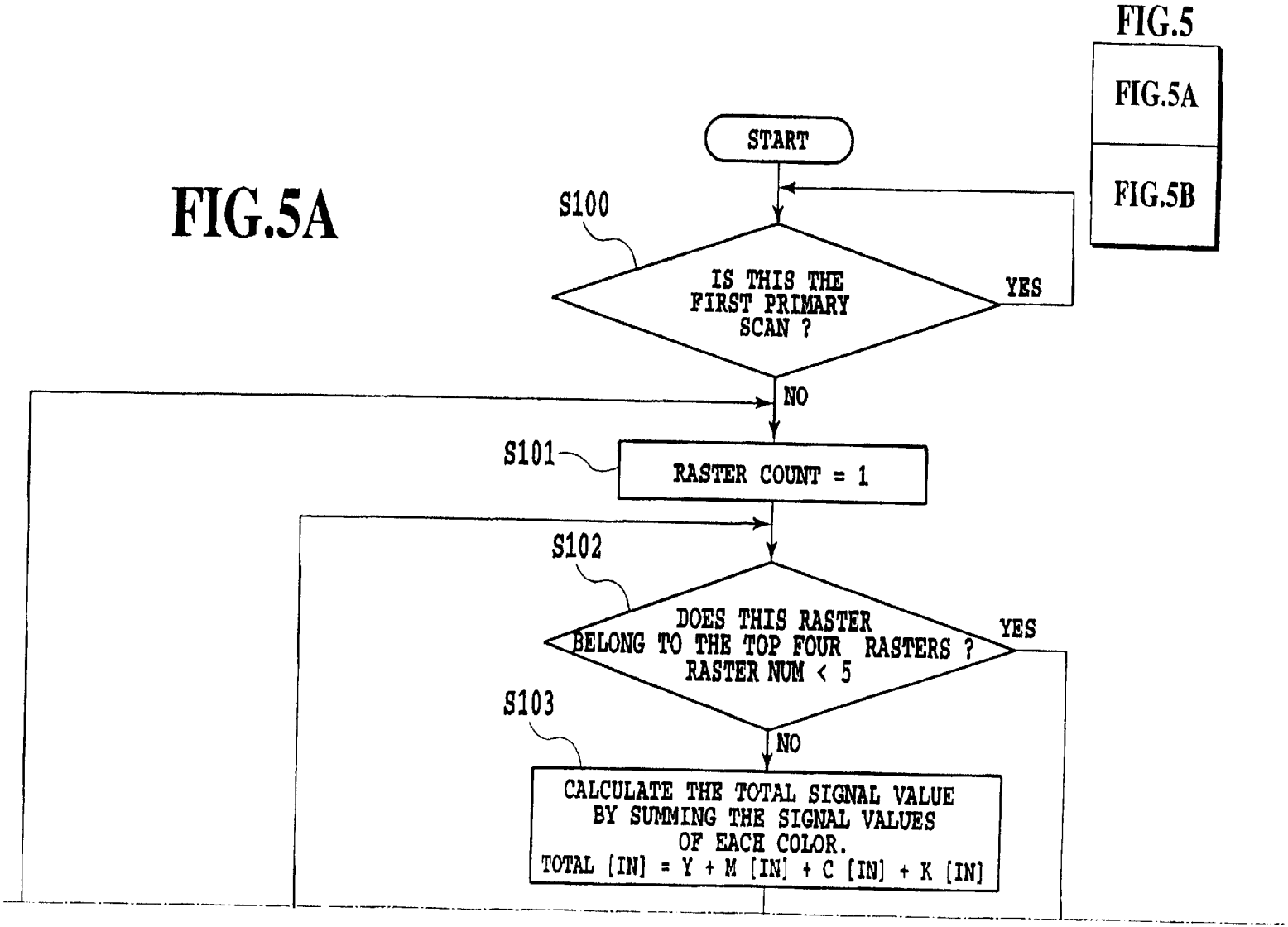
FIG. 5A is a flowchart illustrating the boundary correction method described in Embodiment 1 of this invention.
Figure 5B:
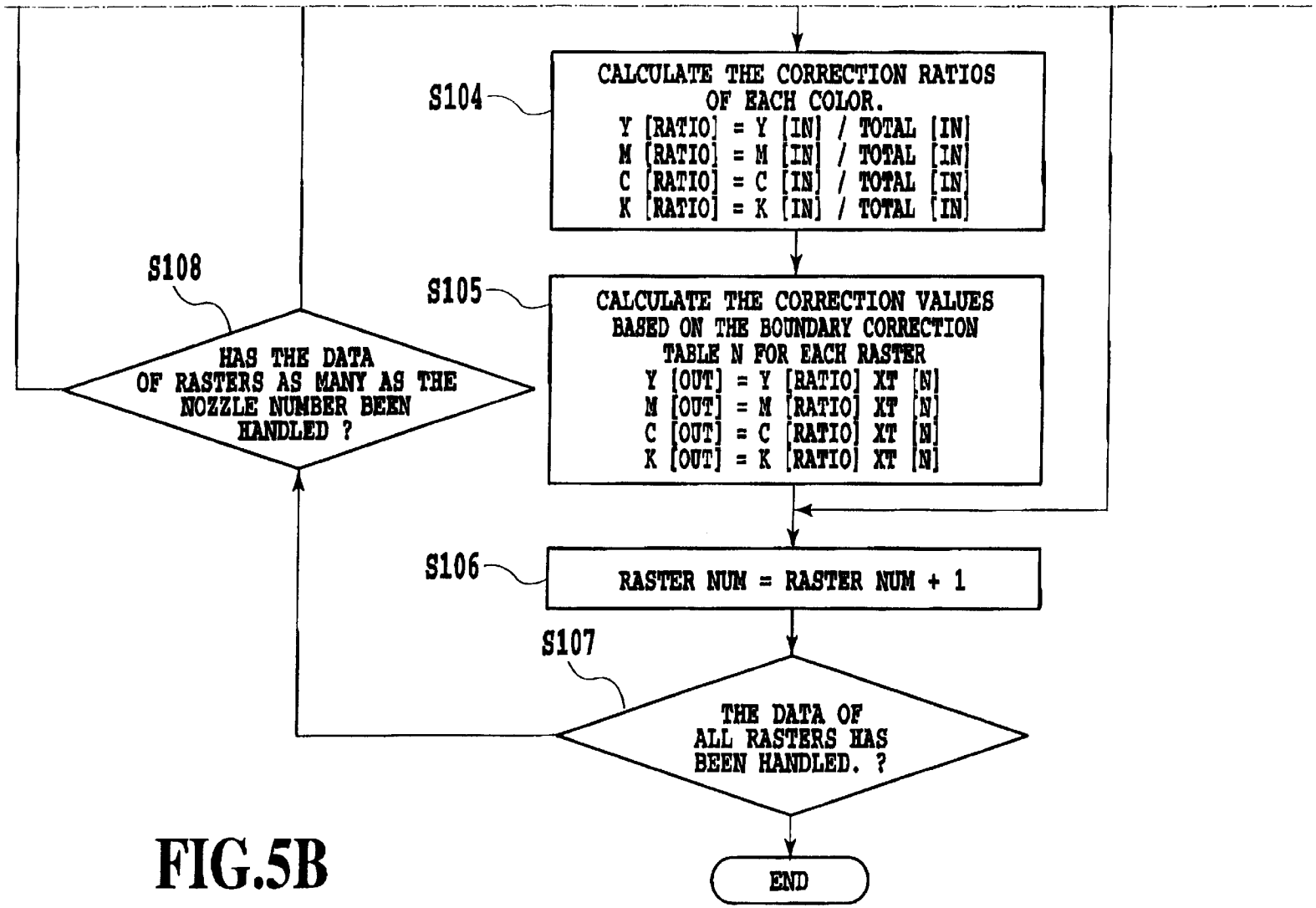
FIG. 5B is a flowchart illustrating the boundary correction method described in Embodiment 1 of this invention.

FIGS. 5A and 5B are flowcharts that explain the boundary correction process performed in the embodiment of the present invention.

When the printing system performs printing, firstly, the host computer handles print data based on the signal processing flow shown in FIG. 4, and then the output γ correction part 213 in the information processing part 230 conducts the following boundary correction for the obtained multi-valued print signals for each C, M, Y and K color.

That is, when C, M, Y and K print signals are transmitted, they are checked whether the signals are those to form the first scanning print area created by the first round of primary scanning or not. If they are the print signals to form the first scanning print area, since the rasters 1–4 thereof are not located in a boundary area, the boundary correction process described in steps 101–109 is not carried out. If the input print signals are those to form the second or a later scanning print area created by the second or a later round of primary scanning, since the rasters 1–4 thereof become the boundary area connected to the first scanning print area, steps 101–109 are carried out.

First, at step 2, the count of the raster counter in the CPU is set to be one. Next, it is determined whether the count of the raster counter is four or smaller, namely, the input print signals are those for the rasters 1–4 (step 3). If the raster counter stands at five, the correction process moves to step 106. If the count of the raster counter is determined to be four or a smaller value, based on the print signal values Y[IN], M[IN], C[IN] and K[IN] for each color of yellow, magenta, cyan and black, the total of those print signal values Total[IN] is calculated (step 103).

This total print signal value is calculated by the formula:

$$\text{Total}[IN]=Y[IN]+M[IN]+C[IN]+K[IN],$$

where the maximum of the total print signal value Total [IN] is 255×4=1020, since the maximum of the print signal value for each color is 255. When it is 1020, the amount of ink ejected from the print heads reaches a maximum, namely, 400 percent.

Next, the ratios of correction for each print signal value (Y[Ratio], M[Ratio], C[Ratio] and K[Ratio]) are calculated from the input print signal values (Y[IN], M[IN], C[IN] and K[IN]) for each color and the total print signal value (Total[IN]) (step 104).

Namely, these correction ratios are given by:

$$Y[Ratio]=Y[IN]/Total[IN]$$

$$M[Ratio]=M[IN]/Total[IN]$$

$$C[Ratio]=C[IN]/Total[IN]$$

$$K[Ratio]=K[IN]/Total[IN].$$

Then, the product of the value (T[N]) read out from the boundary stripe correction table based on the obtained total print signal value (Total[IN]) for each raster and the above obtained correction ratio becomes the corrected print signal value (Y[OUT], M[OUT], C[OUT] and K[OUT]) (step 105).

Namely, the print signal values after correction are given by:

Y[OUT]=Y[Ratio]/T[N]

M[OUT]=M[Ratio]/T[N]

C[OUT]=C[Ratio]/T[N]

K[OUT]=K[Ratio]/T[N].

At step 107 the raster counter is incremented, and it is determined from the value of the raster counter whether the boundary correction has been completed on the print signals of all rasters (step 106). If completed, the boundary correction process is ended (step 107). Further, it is determined whether the correction process has been completed on the print signals of all rasters that are to be printed onto the printing medium. If completed, the correction process comes to a halt.

Unless completed entirely, it is then determined from the count of the raster counter whether the printing of rasters corresponding to the number (255) of nozzles mounted on the print head 5 has been completed. If the number of rasters has reached that of nozzles, it is determined that the print signals for one scanning print area have undergone correction. Then the count of the raster counter is reset to one and steps 102–108 are conducted on the print signals for the adjacent scanning print area. Further, unless the count of the raster counter has reached the number of nozzles, the process moves to step 102 and then steps 103–108 are carried out.

Yet, if it is concluded that the number of rasters is five or larger at step 102, namely, if it is concluded that the input print signals are those for an area other than the boundary area, the process moves to step 106 and the count of the raster counter is incremented by one, without performing the above-mentioned correction. Thereafter the steps except for 103–106 are repeated until the count of the counter has reached the number of nozzles.

<Boundary Stripe Correction Table>

Next, the boundary stripe correction table used in the computation at step 105 is explained.

Figure 6:
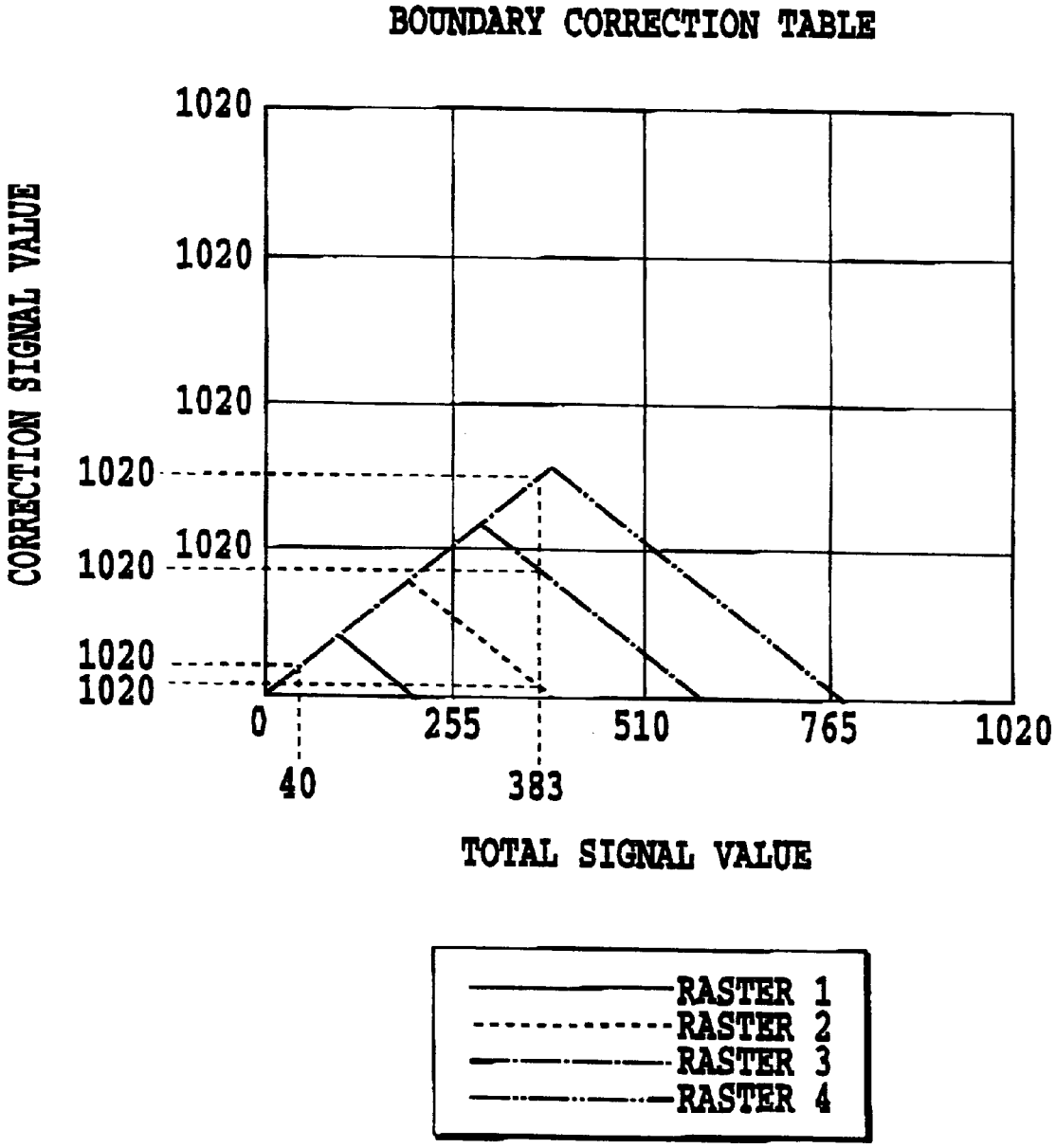
FIG. 6 is a graph showing the contents of the boundary correction table described in Embodiment 1 of this invention.

FIG. 6 is a graph showing the contents of the boundary correction stripe table.

In this figure, the horizontal axis represents the total signal value and the vertical axis represents correction values for each total signal value. Among the curves shown in this figure, the solid curve is that for raster 1, the dotted one for raster 2, the dot-dash one for raster 3, and the two-dot chain for raster 4. As shown in FIG. 1, raster 1 is the raster closest to the last (256th) raster in the area (preceding scanning print area) that is to be printed first of the scanning print areas E1 and E2 which are adjacent to each other. The raster counter stands at one for this raster at step 101. In the direction departing from raster 1 along the sub-scanning direction, raster 2, raster 3, raster 4 . . . are located.

Threshold values P1, P2, P3 and P4 are determined on each correction curve. In the range within those threshold values, the correction value increases or decreases according to an increase or decrease, respectively, in the total signal value. In the range exceeding those threshold values, the correction value decreases or increases according to an increase or decrease, respectively, in the total signal value. In this embodiment of the invention, the relationship between the total signal value and the correction value is proportional and its coefficient is one. Therefore, the total signal value agrees with the correction value in the range up to the threshold values. In the range exceeding the threshold values, the correction value decreases linearly corresponding to an increase in the total siganal value and its minimum value is zero.

For example, correction is initiated around the total signal value=100 (ink ejection=100/1020×400=about 39%) to reduce the number of dots. Around at the total signal value=200 (ink ejection 200/1020×400=about 78%), the correction signal value becomes zero to remove all dots.

The above results imply that when the total ejection of ink for the boundary area is approximately 78 percent a black stripe does not appear in the boundary if there is no print on the raster closest to the preceding printed area E1. Similarly for raster 2, raster 3 and raster 4, correction to reduce the number of dots is initiated when the total signal value exceeds each threshold value.

When printing shown in FIGS. 7A and 7B, for example, is performed by the use of the boundary stripe correction table, the following print correction value is calculated by the aforementioned correction process for the boundary area of the second or a later scanning print area by the host computer.

Figure 7A:
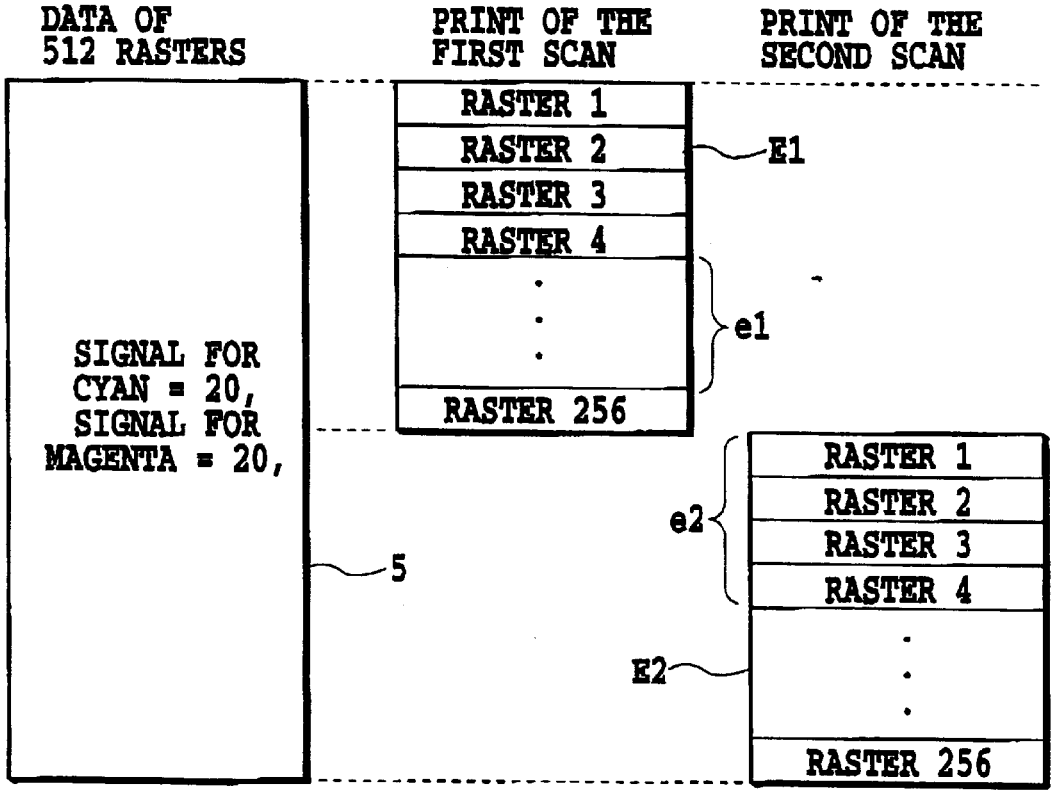
FIGS. 7A and 7B is a schematic diagram that illustrates printing operation described in Embodiment 1 of this invention.
Figure 7B:
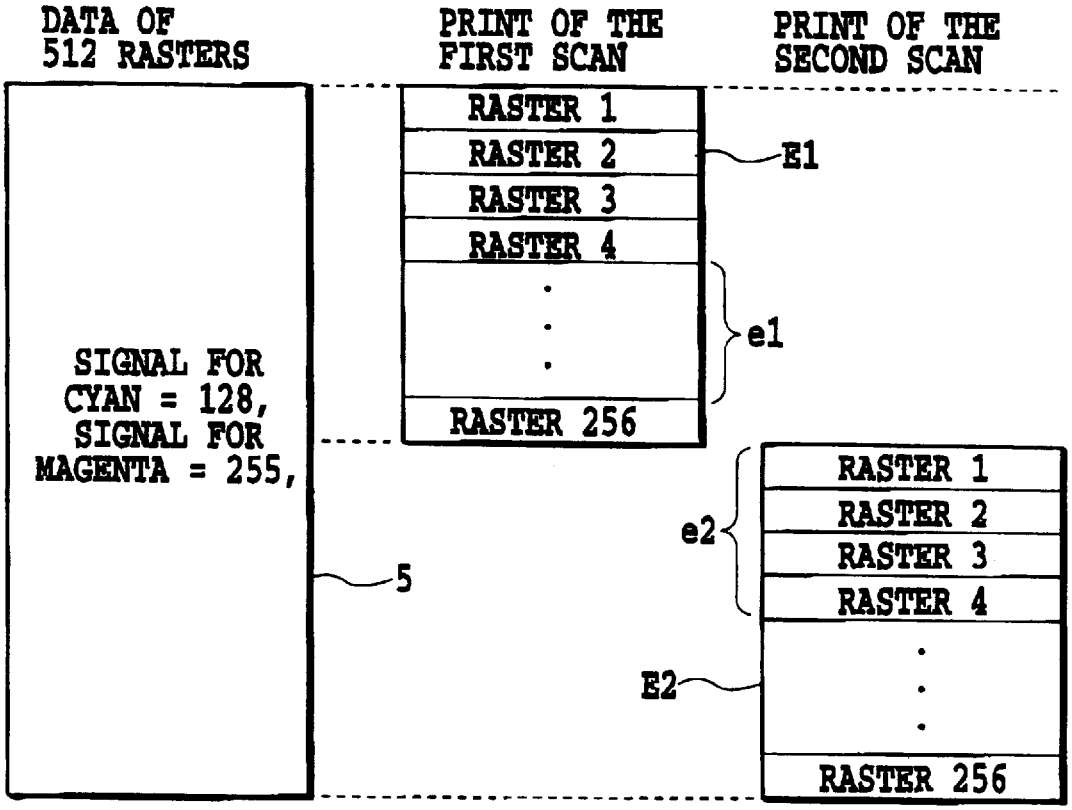

FIGS. 7A and 7B are schematic diagrams illustrating the printing operation carried out by the print head 5 equipped with 256 nozzles. FIG. 7A shows the case where printing of 512 rasters is carried out with the cyan print signal value C[IN]=20 and the magenta print signal value M[IN]=20, namely, that is, two scanning print areas E1 and E2 are formed by two subsequent primary scans. FIG. 7B is the case where printing of 512 rasters (printing of E1 and E2) is carried out with the cyan print signal value C[IN]=128 and the magenta print signal value M[IN]=255 also by two subsequent primary scans. The real ink ejection rates at each printing operation are 20/255×2×100=about 16% in FIG. 7A, and (128/255+255/255)×100=about 150% in FIG. 7B.

When forming the above scanning print areas E1 and E2, the print signal correction values for the boundary area e2 (top four rasters) in the lower scanning print area E2 are calculated as follows.

Since C[IN]=20 and M[IN]=20 in the printing operation shown in FIG. 7A, the total signal value Total[IN] is given by:

Total signal value Total[IN]=20+20=40.

Then the correction values T1–T4 that are read out from each table based on this total signal value are T1=40, T2=40, T3=40 and T4=40.

Therefore, the correction values for cyan and magenta in rasters 1–4 are given as follows.

Raster 1:

C[OUT]=C[IN]/Total[IN]×T1=20/40×40=20

M[OUT]=M[IN]/Total[IN]×T1=20/40×40=20

Raster 2:

C[OUT]=C[IN]/Total[IN]×T2=20/40×40=20

M[OUT]=M[IN]/Total[IN]×T2=20/40×40=20

Raster 3;

C[OUT]=C[IN]/Total[IN]×T3=20/40×40=20

M[OUT]=M[IN]/Total[IN]×T3=20/40×40=20

Raster 4:

C[OUT]=C[IN]/Total[IN]×T4=20/40×40=20

M[OUT]=M[IN]/Total[IN]×T4=20/40×40=20.

The above results imply that when the ink ejection is about 16 percent It is possible to prevent or eliminate the emergence of a black stripe in the boundary area by performing no correction.

Since C[IN]=128 and M[IN]=255 in the printing operation shown in FIG. 7B, the total signal value Total[IN] is given by:

Total signal value Total[IN]=128+255=383.

Then the correction values T1–T4 that are read out from each table based on this total signal value are T1=0, T2=15, T3=215 and T4=383.

As shown here, when printing is performed with an ink ejection of about 150 percent, the emergence of black stripes in the boundary areas e1 and e2 can be prevented by increasing the dot reduction rate from zero percent (for raster 4) to 100 percent (for raster 1) in decreasing order of distance from the preceding printed area. That is, when the total signal value Total[IN] has reached a significant magnitude of 383 for example, ink may spread to the preceding boundary area e1 that has already been formed and a black stripe may appear, if no correction is performed during printing. However, in this embodiment of the invention, since the signal value is set to be zero for raster 1 and very small values are set for raster 2 as C[IN]=5 and M[IN]=10, there is no spread of ink to the boundary area e1 and the prevention of emergence of a black stripe is ensured.

The first embodiment of this invention has been explained as an example where whole 512 rasters are printed in cyan ink and magenta ink by uniform print signals. However, it is obvious that the present invention can be applied to the case where printing is performed with yellow, magenta, cyan and black ink by variant printing signals as in the case of drawing natural-color images. Also in this case, images of high quality can be provided with no emergence of black stripes.

[Second Embodiment]

In the first embodiment, the boundary correction was performed under the assumption that black stripes of each color in the boundary area are recognized with the same sensitivity if the signal values for each color have the same value.

However, black stripes of the same signal value are sometimes recognized in different ways depending on ink composition and human visual perception.

In this second embodiment, a boundary correction is performed that corresponds to difference in the recognition level of black stripes created by combination of colors.

In the following, the boundary correction process used in this second embodiment is explained.

In this boundary correction process, input printing signals Y[IN], M[IN], C[IN] and K[IN] are discomposed into the third, second and first order color elements, and then each value for those elements is calculated. Third-order color element CMY is given by the smallest value in the cyan (C), magenta (M) and yellow (Y) signal values. Second-order color elements blue (B), green (G) and red (R) are the smaller values in each pair of C and M, C and Y, and M and Y signal values. Each of first-order color elements Y, M and C is given by subtracting the third-order color element and two second-order color elements from each input signal value. The first-order color element has the same value as the input value.

Namely, the third-order color element is given by:

CMY=MIN(C[IN], M[IN], Y[IN]).

The second-order color elements are given by:

B=MIN(C[IN], M[IN])

G=MIN(C[IN], Y[IN])

R=MIN(M[IN], Y[IN]).

The first-order color elements are given by:

Y=Y[IN]−(CMY+G+R)

M=M[IN]−(CMY+B+R)

C=C[IN]−(CMY+B+G)

K=K[IN].

Then the correction values for yellow, magenta, cyan and black (TotalY, TotalM, TotalC, TotalK) are determined by multiplying a1–a3, b1–b3, c1–c3 and d1, which are correction coefficients corresponding to each recognition level of black stripes by the above each element.

Namely, the print signal correction values are given by:

TotalY=(a1×Y)+(a2×G)+(a2×R)+(a3×CMY)

TotalM=(b1×Y)+(b2×G)+(b2×R)+(b3×CMY)

TotalC=(c1×Y)+(c2×G)+(c2×R)+(c3×CMY)

TotalK=d1×K.

Next, the total signal correction value TotalS is derived by adding the signal correction values of each color. Namely, the total signal correction value TotalS is given by:

TotalS=TotalY+TotalM+TotalC+TotalK.

Then, the correction ratios (Y[Ratio], M[Ratio], K[Ratio]) are calculated by the previously obtained signal correction values (TotalY, TotalM, TotalC, TotalK) and the total signal correction value TotalS.

Namely, each correction ratio is given by:

Y[Ratio]=TotalY/TotalS

M[Ratio]=TotalM/TotalS

C[Ratio]=TotalC/TotalS

K[Ratio]=TotalK/TotalS.

The signal correction values for rasters 1–4 (Y[OUT], M[OUT], C[OUT], K[OUT]) are derived by multiplying the above correction ratios by the correction table value T[N] that is read out from the correction table according to the above total signal correction value TotalS.

Namely, the correction values for each color are given by:

Y[OUT]=Y[Ratio]×T[N]

M[OUT]=M[Ratio]×T[N]

C[OUT]=C[Ratio]×T[N]

K[OUT]=K[Ratio]×T[N], (N=1, 2, 3, 4).

As explained above, in this second embodiment, because the input print signal is discomposed into the first-, second- and third-order color elements, and correction is performed for each color by multiplying the correction coefficients, correction can be carried out on black stripes corresponding to recognition levels varied by ink characteristics and the human visual perception.

[Other Embodiments]

In the above embodiment, the correction process was employed to the boundary area formed by primary scanning between adjacent upper and lower scanning print areas. However, prior to this correction process, if a raster-to-raster density correction is carried out on all rasters, not only correction in each scanning print area but also the prevention of density fluctuations and stripes are realized, resulting in images of higher quality. This correction between rasters can be conducted by referring to correction tables associated with each raster, with the same process routine available in common. That is, in the boundary correction process shown in FIG. 5, if the print signal input at step 102 is determined to be a signal for rasters 1–4, it is possible to move to step 105 where a correction is conducted by the use of correction tables prepared for each raster, rather than moving to step 103 as the case of the above embodiment.

Further, when both a raster-to-raster density correction for all rasters and the above boundary correction are performed together, it becomes possible to carry out both corrections by a single routine, provided that a common correction table is prepared that has values resulting from applying the boundary correction to the obtained corrected values for each raster. In this case, for the rasters other than rasters 1–4 used in the boundary correction, tables may be prepared where the input value is the same as the output value for the sake of convenience.

In the above embodiments, of the adjacent upper and lower boundary areas, the lower boundary area was used in both calculating the total print signal and conducting signal correction in this area. However, the area where the total print signal is calculated is not limited to the lower boundary area. It is also possible to use the upper boundary area or both upper and lower boundary areas for the calculation. Similarly, the target area that is subject to correction based on the obtained total print signal is not limited to the lower boundary area. The upper boundary area or the combination of the upper and lower areas can be the target for the correction.

Therefore, it is possible to correct print signals for the lower boundary area based on the total print signal of the upper boundary area, and it is also possible to correct print signals for either upper or lower boundary area based on the total print signals of both upper and lower boundary areas. In all these cases, correction is effective to prevent the emergence of black stripes.

It is assumed in the above embodiment that each boundary area consists of four rasters; however, it is evident that a boundary area may consist of any number of rasters. It is essential only that the boundary area be defined over the raster range where black stripes may appear.

Further, in the above embodiment, a host computer conducted corrections including the boundary correction. However, instead of a host computer, a printing system may be used to conduct those corrections.

Although in the above embodiment the prevention of emergence of black stripes caused by ink smearing was discussed, there are printing systems that frequently present what is called a white stripe, namely, the boundary area where ink is not applied sufficiently because of a shortage of paper feed and an inclination of the ink ejection angle, for example. It is also possible to prevent emergence of white stripes in those printing systems by rendering the print signal larger than the input value to intentionally generate ink smearing when the total print signal value is smaller than the threshold value.

The present invention may be adopted to systems consisting of a plurality of devices (for example, host computer, interface devices, reader, and printer), as mentioned above, and it may also be adopted to systems made up of a single apparatus (such as copier and facsimile).

Further, although in the above embodiments, the density data obtained prior to binarization was corrected by the use of correction tables, the way of correction to eliminate black stripes is not limited to those shown in the above embodiments. The present invention may include, for example, the way of correction by changing the amount of elected ink itself, modulating the pulse width of the driving signals controlling each thermal device in the print head.

Further, if software program code for implementing the functions described in aforementioned embodiments is installed in a computer in a device or a system connected to devices that are designed to realize the functions described in the aforementioned embodiments, and those devices are operated by the program installed in the computer (CPU or MPU) of the device or the system, this is part of the present invention.

In this case, the software program code itself implements the functions described in the embodiments. This program code itself and the means to install this program code in the computer, for example, a storage device that stores this program code, also comprise the present invention.

As such a storage device where the program code is stored, for example, floppy disk, hard disk, optical disk, magneto-optical disk, CD-ROM, magnetic tape, nonvolatile RAM card, and ROM can be used.

Embodiments of the present invention include not only the execution of the provided program code by a computer, but also the execution of the functions described in the embodiments implemented by cooperation between the program code and the OS (operating system) or another application software program running in the computer.

Also, if the provided program code is stored in a memory mounted in a function expansion board of the computer or in a function expansion unit connected to the computer and later a CPU of those expansion board and unit, for example, executes part or all process to realize the functions described in the embodiments, this is included in the present invention.

As explained above, the present invention allows to perform printing on the boundary area with the right amount of ink and eventually to prevent emergence of black stripes by: calculating the total of printing signal values for printing onto at least one boundary area of the upper and lower adjacent boundary areas included in the upper and lower adjacent scanning print areas formed by the print heads; and by, responding to the magnitude of this total print signal value, performing correction on the magnitude of the print signal value for printing onto the boundary by the use of the print signal for at least one area of the upper and lower adjacent boundary areas. Further, the present invention allows high-speed printing because each of the subsequently printed areas is forwarded a full-scanning length upon each scan by the heads and those printed areas do not overlap each other.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing signal processing apparatus for providing printing signals to a printing apparatus for forming an image on a printing medium, wherein the printing apparatus alternately repeats (i) a primary scanning operation for relatively moving a carriage provided with printing heads corresponding to a plurality of colors over the printing medium in a primary scanning direction and driving the printing heads based on binary printing signals obtained from multi-valued printing signals to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing signal processing apparatus comprising:

means for calculating a total value of multi-valued printing signal values for all colors corresponding to a pixel in at least one of upper and lower adjacent boundary areas in upper and lower adjacent scanning print areas; and means for correcting the printing signals for carrying out correction of decreasing multi-valued printing signal values for all colors corresponding to a pixel in which the calculated total value exceeds a threshold value, wherein the threshold value corresponding to the pixel depends on the position of the pixel.

2. A printing signal processing apparatus according to claim 1, wherein said means for calculating the total value of multi-valued printing signal values calculates based on the printing signals which are sent to each of the printing heads for printing onto the lower boundary area of the upper and lower adjacent boundary areas in the upper and lower adjacent scanning print areas formed by the printing heads.

3. A printing signal processing apparatus according to claim 1 or 2, wherein said means for correcting the printing signals corrects the printing signals of the lower boundary area of the upper and lower adjacent boundary areas in the upper and lower adjacent scanning print areas, based on the total value of printing signals.

4. A printing signal processing apparatus according to claim 1, wherein said means for correcting printing signals corrects the printing signals so that the printing signals sent to each printing head are discomposed into N-order (N=$1^{st}$, $2^{nd}$, $3^{rd}$) element signals of the colors of colorants stored in each printing head and the element signals of each print color are subject to a first correction, said means for calculating the total value of multi-valued printing signal values calculates the total value so that the corrected element signals are summed up for each print head to perform the first correction for each color, and that the total of the corrected signal values by the first correction is calculated for the printing heads, and said means for correcting printing signals corrects the printing signals so that the printing signals of at least one of the upper and lower adjacent boundary areas are corrected, based on the total value of the first corrected signal values calculated by said means for calculating the total value of multi-value printing signal values.

5. A printing signal processing apparatus according to claim 1, wherein said means for correcting printing signals corrects the printing signals so that when the total value of printing signals for the boundary area is equal to the threshold value or smaller, the printing signals are increased or decreased as the input printing signals are increased or decreased, respectively, while the printing signals are decreased or increased as the input printing signals are increased or decreased, respectively, when the total value of printing signals for the boundary area exceeds the threshold value.

6. A printing signal processing apparatus according to claim 5, wherein the upper boundary area is comprised of a plurality of rasters, and the threshold values determined for the correction of printing signals have different values for each raster, each threshold value being determined based on the distance from each raster to the adjacent scanning print area.

7. A printing signal processing apparatus according to claim 5 or 6, wherein said means for correcting printing signals corrects the printing signals so that when the total value of signals for the printing of a boundary area falls into the range exceeding the threshold value determined for each raster, the minimum of the printing signals for each raster in the range is determined to be zero.

8. A printing signal processing apparatus according to claim 1, wherein said carriage is equipped with four types of printing heads that print colorants of yellow (Y), cyan (C), magenta (M), and black (K).

9. A printing signal processing apparatus according to claim 1, wherein said means for correcting printing signals corrects the density represented by the printing signals.

10. A printing signal processing apparatus for providing printing signals to a printing apparatus for forming an image on a printing medium, wherein the printing apparatus alternately repeats (i) a primary scanning operation for relatively moving a carriage provided with printing heads corresponding to a plurality of colors over the printing medium in a primary scanning direction and driving the printing heads based on binary printing signals obtained from multi-valued printing signals to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing signal processing apparatus comprising:

means for calculating a total value of multi-valued printing signal values for all colors corresponding to a pixel in at least one of upper and lower adjacent boundary areas in upper and lower adjacent scanning print areas; and means for correcting the printing signals for carrying out correction of decreasing multi-valued printing signal values for all colors corresponding to a pixel in which the calculated total value exceeds a threshold value, wherein a smaller threshold value is used in a pixel a shorter distance from a boundary line between the adjacent scanning print areas.

11. A printing apparatus for alternately repeating (i) a primary scanning operation for relatively moving a carriage provided with printing heads corresponding to a plurality of colors over a printing medium in a primary scanning direction and driving the printing heads to form an image on a scanning printing area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing apparatus comprising:

means for calculating a total value of multi-valued printing signal values for all colors corresponding to a pixel in at least one of upper and lower adjacent boundary areas in upper and lower adjacent scanning print areas;

means for correcting the printing signals for carrying out correction of decreasing multi-valued printing signal values for all colors corresponding to a pixel in which the calculated total value exceeds a threshold value;

means for converting the multi-valued printing signals corrected by the means for correcting the printing signals into binary printing signals; and means for driving the printing heads based on the converted binary printing signals, wherein the threshold value corresponding to the pixel depends on the position of the pixel.

12. A printing apparatus according to claim 11, wherein said means for calculating the total value of multi-valued printing signal values calculates the printing signals sent to each of the printing heads for printing with respect to the lower boundary area of the upper and lower adjacent boundary areas in the upper and lower adjacent scanning print areas formed by the printing heads.

13. A printing apparatus according to claim 11 or 12, wherein said means for correcting the printing signals corrects the lower boundary area of the upper and lower adjacent boundary areas in the upper and lower adjacent scanning print areas, based on the total value of printing signals.

14. A printing apparatus according to claim 11, wherein said means for correcting printing signals corrects the printing signals so that the printing signals sent to each printing head are discomposed into N-order ($1^{st}$, $2^{nd}$, $3^{rd}$) element signals of the colors of colorants stored in each printing head and the element signals of each print color are subject to a first correction, said means for calculating the total value of multi-valued printing signal values calculates the total value so that the corrected element signals are summed up for each printing head to perform the first correction for each color, and that the total value of the corrected signal values is calculated for the printing heads, and said means for correcting printing signals corrects the printing signals so that the printing signals of at least one of the upper and lower adjacent boundary areas are corrected, based on the total value of the first corrected signal values calculated by said calculating means.

15. A printing apparatus according to claim 11, wherein said means for correcting printing signals corrects the printing signals so that when the total value of printing signals for the boundary area is equal to or smaller than the threshold value, the printing signals are increased or decreased as the input printing signals are increased or decreased, respectively, while the printing signals are decreased or increased as the input printing signals are increased or decreased, respectively, when the total value of printing signals for the boundary area exceeds the threshold value.

16. A printing apparatus according to claim 15, wherein the upper boundary area is comprised of a plurality of rasters, and wherein the threshold values determined for the correction of printing signals have different values for each raster, the magnitude of each threshold value being determined based on the distance from each raster to the adjacent scanning print area.

17. A printing apparatus according to claim 15, wherein said means for correcting printing signals corrects the printing signals so that when the total value of signals for the printing of a boundary area falls into the range exceeding the threshold value determined for each raster, the minimum of the printing signals for each raster in the range is determined to be zero.

18. A printing apparatus according to claim 11, wherein said carriage is equipped with four types of printing heads that print colors of yellow (Y), cyan (C), magenta (M), and black (K).

19. A printing apparatus according to claim 11, wherein said means for correcting printing signals corrects the density value represented by the printing signals.

20. A printing apparatus according to claim 11, wherein said means for correcting printing signals corrects the control signals for the printing elements.

21. A printing apparatus for alternately repeating (i) a primary scanning operation for relatively moving a carriage provided with printing heads corresponding to a plurality of colors over a printing medium in a primary scanning direction and driving the printing heads to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing apparatus comprising:

means for calculating a total value of multi-valued printing signal values for all colors corresponding to a pixel in at least one of upper and lower adjacent boundary areas in upper and lower adjacent scanning print areas;

means for correcting the printing signals for carrying out correction of decreasing multi-valued printing signal values for all colors corresponding to a pixel in which the calculated total value exceeds a threshold value;

means for converting the multi-valued printing signals corrected by the means for correcting the printing signals into binary printing signals; and means for driving the printing heads based on the converted binary printing signals, wherein a smaller threshold value is used in a pixel a shorter distance from a boundary line between the adjacent scanning print areas.

22. A printing signal processing method for carrying out a printing method of alternately repeating (i) a primary scanning operation for relatively moving a carriage provided with printing heads corresponding to a plurality of colors over a printing medium in a primary scanning direction and driving the printing heads based on binary printing signals to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing signal processing method comprising the steps of:

calculating a total value of multi-valued printing signal values for all colors corresponding to a pixel in at least one of upper and lower adjacent boundary areas in upper and lower adjacent scanning print areas;

correcting the printing signals for carrying out correction of decreasing multi-valued printing signal values for all colors corresponding to a pixel in which the calculated total value exceeds a threshold value; and converting the corrected multi-valued printing signals into the binary printing signals, wherein the threshold value corresponding to the pixel depends on the position of the pixel.

23. A printing signal processing method for carrying out a printing method of alternately repeating (i) a primary scanning operation for relatively moving a carriage provided with printing heads corresponding to a plurality of colors over a printing medium in a primary scanning direction and driving the printing heads based on binary printing signals to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing signal processing method comprising the steps of:

calculating a total value of multi-valued printing signal values for all colors corresponding to a pixel in at least one of upper and lower adjacent boundary areas in upper and lower adjacent scanning print areas;

correcting the printing signals for carrying out correction of decreasing multi-valued printing signal values for all colors corresponding to a pixel in which the calculated total value exceeds a threshold value; and converting the corrected multi-valued printing signals into the binary printing signals, wherein a smaller threshold value is used in a pixel a shorter distance from a boundary line between the adjacent scanning print areas.

24. A printing method of alternately repeating (i) a primary scanning operation for relatively moving a carriage provided with printing heads corresponding to a plurality of colors over a printing medium in a primary scanning direction and driving the printing heads to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing method comprising the steps of:

calculating a total value of multi-valued printing signal values for all colors corresponding to a pixel in at least one of upper and lower adjacent boundary areas in upper and lower adjacent scanning print areas;

correcting the printing signals for carrying out correction of decreasing multi-valued printing signal values for all colors corresponding to a pixel in which the calculated total value exceeds a threshold value;

converting the corrected multi-valued printing signals into binary printing signals; and driving the printing heads based on the converted binary printing signals, wherein the threshold value corresponding to the pixel depends on the position of the pixel.

25. A printing method of alternately repeating (i) a primary scanning operation for relatively moving a carriage provided with printing heads corresponding to a plurality of colors over a printing medium in a primary scanning direction and driving the printing heads to form an image on a scanning print area corresponding to an array width of printing elements of the printing heads and (ii) a sub-scanning operation for moving the printing medium relative to the printing heads by an amount corresponding to the array width of the printing elements in a sub-scanning direction orthogonal to the primary scanning direction to sequentially form an image on a plurality of adjacent scanning print areas in the sub-scanning direction, said printing method comprising the steps of:

calculating a total value of multi-valued printing signal values for all colors corresponding to a pixel in at least one of upper and lower adjacent boundary areas in upper and lower adjacent scanning print areas;

correcting the printing signals for carrying out correction of decreasing multi-valued printing signal values for all colors corresponding to a pixel in which the calculated total value exceeds a threshold value;

converting the corrected multi-valued printing signals into binary printing signals; and driving the printing head based on the converted binary printing signals, wherein a smaller threshold value is used in a pixel a shorter distance from a boundary line between the adjacent scanning print areas.

* * * * *